US005638702A

United States Patent [19]

Zieve

[11] Patent Number: 5,638,702

[45] Date of Patent: Jun. 17, 1997

[54] KNITTING-WRAPPING UNIT AND DEVICE FOR EFFECTUDTING WRAPPING PROCEDURE

[76] Inventor: William A. Zieve, 48 Chester St., E. Northport, N.Y. 11731

[21] Appl. No.: 379,189

[22] Filed: Jan. 27, 1995

[51] Int. Cl.[6] ..... D04B 9/32

[52] U.S. Cl. ..... 66/135

[58] Field of Search ..... 66/135, 125 R

[56] References Cited

U.S. PATENT DOCUMENTS 2,160,614 5/1939 Fenstermacher ..... 66/135

2,233,738 3/1941 Grill ..... 66/135

3,592,024 7/1971 Levin ..... 66/135 X 3,995,455 12/1976 Hayashi et al. ..... 66/135

*Primary Examiner*—John J. Calvert

[57] ABSTRACT

A yarn wrapping device for a knitting machine whereby a wrap yarn is fed across selected needles of a group to form a longitudinal pattern. The wrap is effectuated by the combination of a circumferential movement of a horizontal actuating cam engaging a pendulous bar mounted to move in a vertical plane angularly disposed to the radius of the cylinder carrying with it a bowed flat spring having a yarn guide hole.

3 Claims, 2 Drawing Sheets

KNITTING-WRAPPING UNIT AND DEVICE FOR EFFECTUDTING WRAPPING PROCEDURE

This invention relates to a yarn wrapping device for a knitting machine.

BACKGROUND OF THE INVENTION

Various devices have been designed to knit wrap yarn longitudinally in combination with the weft knit ground fabric. These have been relatively intricate, bulky and expensive. Since the mechanisms to operate these are confined in a smaller circle, few of them can be placed along the needle circle. These are also difficult to get to for repairs, maintenance or replacement.

Some large diameter multiple feed machines are being built, mostly with rotating needle cylinders. The ancillary parts necessary to rotate and co-operate with the cylinder needles for wrap striping become very costly and heavy. Weight is an important factor as a knitting machine has to stop instantly, when the automatic stop mechanism detects a fault. When this machine stops instantly the co-operating wrapping parts get shaken up.

SUMMARY OF THE INVENTION

The parts in the present invention are comparatively very light and the device can be easily applied. The angular positions of some of the parts may be changed to suit, depending on the direction of needle cylinder rotation.

The present invention relates to a yarn wrapping device for a knitting machine having a stationary needle cylinder. The device provides a combined movement for a minimal number of parts in a manner to permit closer positioning or "nesting" so that more units can be placed circumferentially to accommodate more selected wrapped needle groups.

An object of this invention is to provide a yarn wrapping device which is less costly, simpler in operation and readily accessible for adjustment, repair or replacement.

DESCRIPTION OF THE PREFERRED EMBODIMENT

Figure 1:
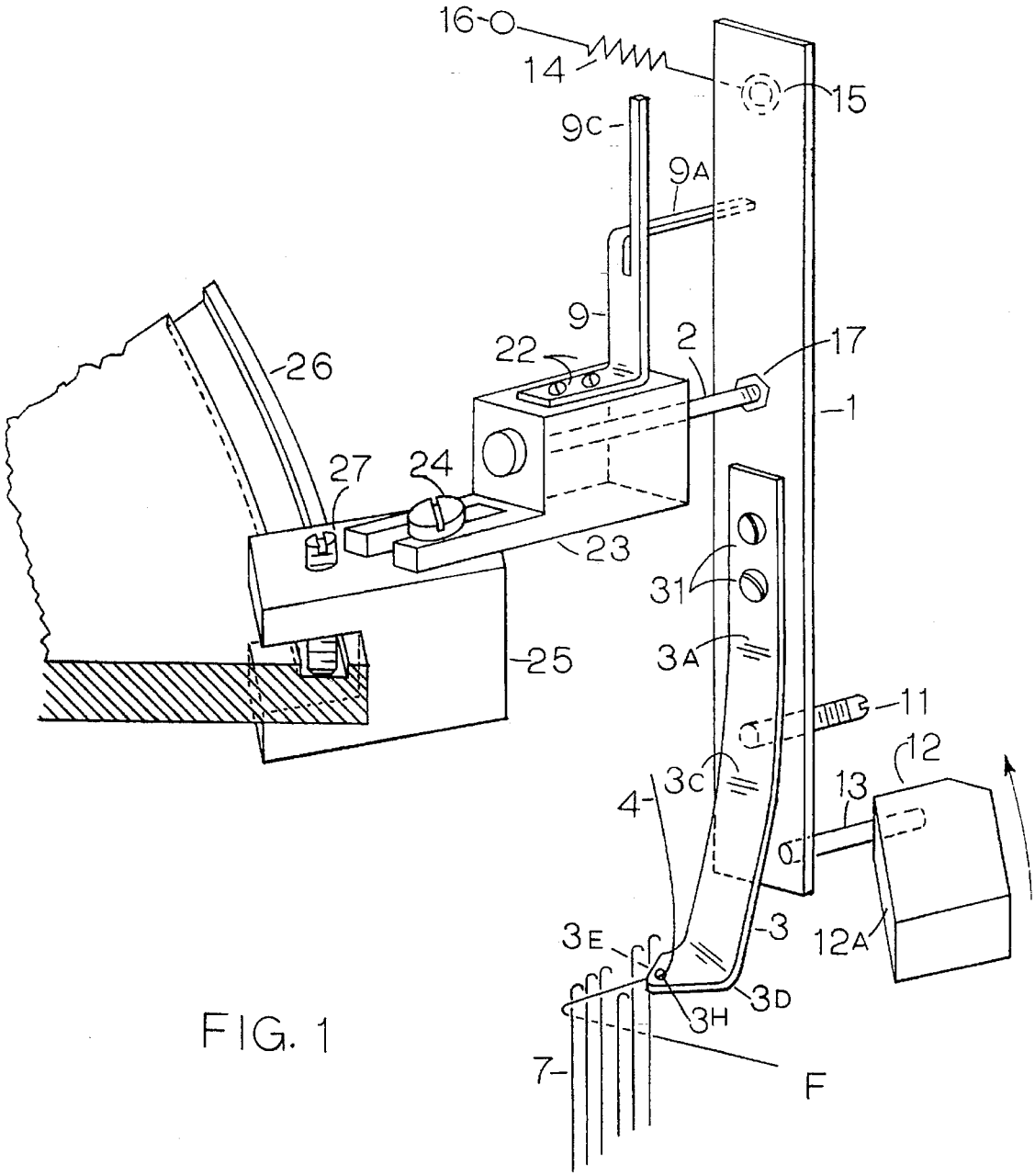
FIG. 1 shows the device mounted on a segment of a horizontal flat disc 26 which is fastened centrally on a supported vertical shaft (not shown) which is coaxial with the needle cylinder. The lower end extends down to the interacting hooks of the selected needles of the group.

In the present invention, the device shown in FIG. 1 is mounted in a multiple feed, open top, circular machine of the stationary cylinder type. The cylinder has slots which carry needles. The needles are actuated vertically by cams in section cam blocks mounted on a gear driven annular ring which encircles the needle cylinder and rotates (looking at the center) from left to right. There is one cam section block for each weft knitting feed.

A fragmentary section of a horizontal flat round disc 26 is mounted on a vertical shaft axially suspended over a needle cylinder (not shown). Round disc 26 and shaft are held stationary relative to the needle cylinder. A series of yarn wrapping devices shown in FIG. 1 are positioned circumferentially on round disc 26, each comprising: a clamp 25, fastened by a set screw 27, on which is mounted horizontally adjustable, a housing 23. A horizontal shaft 2 is journalled in housing 23 for free movement. Shaft 2 is threaded on its end. A pendulous bar 1 is mounted on shaft 2 and fastened to turn therewith by nuts 17, two on each side. An angled piece 9 is fastened on top of housing 23 by two screws 22. The upright end of angled piece 9 is forked. One prong 9C remains straight up. The other prong 9A is bent to form a stop for pendulous bar 1 when it is in its rest position. A helical spring 14 is fastened to the upper end of pendulous bar 1 by screw 15 to pull pendulous bar 1 to a rest position. Loop 16 at the other end of helical spring 14 is mounted on prong 9C of the next circumferentially mounted wrapping unit (not shown). A flat spring 3 is fastened to pendulous bar 1 by two screws 31. Flat spring 3 is bent away from pendulous bar 1 at upper section 3A and bent away more at middle section 3C to form a bowed effect. Screw 11 presses against flat spring 3 to further adjust pressure of flat spring 3 with relation to selected needles of the group 7 at time of contact, as will be explained later. The lower end of flat spring 3 is bent almost to 90° further in the direction of the previous bends. A guide hole 3H through which the wrap yarn is fed to the selected needles of the group 7 is placed in the lower end of the flat spring. The edge 3E is angled to permit the bowed flat spring 3 to glide resiliently along the front below the hooks of the selected needles of group 7 feeding the wrap yarn 4 from left to right. This movement is caused by a horizontal cam 12 adjustably mounted on a vertical post (not shown) one of which is fastened to each weft knitting cam section block (not shown). (If the machine had sinkers, the vertical posts would be fastened on the sinker ring). As the machine runs, the horizontal cam 12 moves circumferentially from left to right pushing against stud 13 which is fastened near the bottom on the front side of pendulous bar 1. The pendulous bar 1 is positioned so it will move when pushed, in a vertical plane angularly disposed to the radius of the needle circle.

Figure 2:
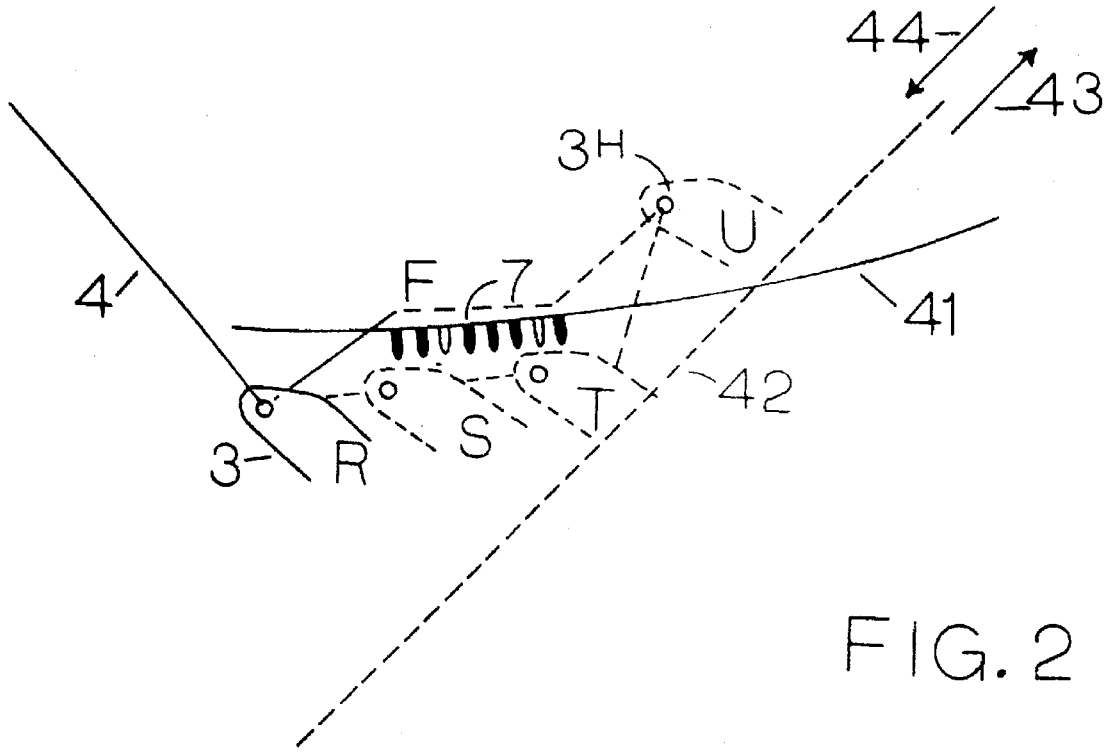
FIG. 2 shows the steps of the wrap yarn being fed as they proceed in the wrapping movements.

In FIG. 2 the yarn 4 was last knitted inside the needle circle in the fabric F (not shown). As cam 12 moves from left to right circumferentially, it pushes stud 13 on pendulous bar 1. Stud 13 on pendulous bar 1 and flat spring 3 mounted on it are caused to move integrally in the direction 43 of the aforementioned angular plane. The angular end of the flat spring moves from position R. This continues until edge 3E encounters the front hooks of the selected needles below the hooks of the group 7. Edge 3E is now at position S. As cam 12 continues moving circumferentially and pushing pendulous bar 1 angularly inward, the flat spring 3 yieldingly unbows as edge E glides resiliently along the front and below the hooks feeding the yarn to the selected needles. When the edge 3E has cleared the last selected needle of the group 7 (position T), the lower part of flat spring 3 jumps back to its previously bowed configuration, whereby the guide hole 3H finds itself inside the needle circle, behind the needles (position U). Location of position U is indeterminable as it happens just when the leading face of cam 12 leaves screw 13. The pendulous bar 1 backs up due to pull of helical tension spring 14 while screw 13 bears against surface 12A of cam 12. Yarn guide hole 3H now finds itself behind the needles of group 7. Guide hole 3H dwells there until the needles of group 7 have descended. At this time cam 12 has disengaged itself from contact with screw 13 and under tension from helical spring 14 pendulous bar 1 returns in direction 44 bringing wrapping yarn in guide hole 3H back to its initial rest position R.

Other studs similar to stud 13 could be positioned to different heights on the pendulous bar 1 to be acted upon by similar cams 12 set at corresponding heights and at different weft feeds depending upon fabric design requirements. Importantly, it should be noted that stud 13 could be omitted for a simpler arrangement albeit with a smaller design range. In which case horizontal cam 12 could push directly against the thin side of pendulous bar 1.

The left to right circumferential movement of the horizontal push cam in combination with the oblique movement of the pendulous bar 1 provides a way for minimizing the space required along the needle circle to complete the yarn wrap around selected needles of the group, by nesting the devices closer together. Thus more devices can be positioned along the circumference of the needle circle. If the group contains more or less needles, the angle at which housing block 23 can be set will allow for a longer or shorter sweep or the pendulous bar 1.

Presently there are multiple feed machines being built having rotary needle cylinders. Some rotate clockwise, some counter clockwise. Those conversant in the art will understand that this device can be applied to these types if necessary angular changes are made to suit.

I claim:

1. In a circular knitting machine, a series of yarn wrapping devices clamped circumferentially on a flat round disc fastened to a vertical shaft and concentrically suspended over a needle cylinder and held in stationary relationship therewith, each of the devices comprising: a clamp carrying a housing fastened angularly adjustable and horizontal with respect to the radius of the cylinder, a horizontal shaft freely journalled in said housing, said horizontal shaft having a pendulous bar having an inner and outer side fixedly attached at a free end of the shaft, a flat spring, an upper end of which is attached to the inner side of said pendulous bar, said flat spring having a lower end thereof bowed away from said inner side, said flat spring having a lower-most portion of said lower end bent at approximately 90 degrees in a direction away from said pendulous bar, said lowermost portion having a guide hole therethrough which the wrap yarn is fed to selected needles of a corresponding group of needles, wherein an extreme outer edge of said lowermost section forms a point and a rounded leading edge for resiliently gliding across the front and below the hooks of said selected needles, said pendulous bar having a screw positioned to penetrate said pendulous bar and bear against a back portion of said flat spring to finetune pressure of the resilient glide, an adjustable horizontal cam for engaging and pushing the lower end of said pendulous bar diagonally inward toward said needle circle until said extreme outer edge encounters the front of selected needles, further movement of said horizontal cam causes said lowermost portion to glide resiliently circumferentially along the front and below the hooks of said selected needles, as said extreme edge leaves the last selected needle said lower end snaps back to its previously bowed configuration, with continued movement of said horizontal cam said lower end under pull of a helical tension spring attached to top of said pendulous bar falls back and dwells on a side surface of said horizontal cam, resulting in said lowermost portion being positioned behind said selected needle group then said needles of said group all descend, said horizontal cam continues to the right losing engagement with said pendulous bar which returns to initial rest position under pull of said helical tension spring.

2. A yarn wrapping device in a knitting machine as set forth in claim 1 in which the horizontal cam engages a stud screwed into a lower end of the pendulous bar.

3. A yarn wrapping device for a knitting machine as set forth in claim 2 but wherein holes at different heights in the pendulous bars are threaded to receive studs to be acted upon by corresponding horizontal actuating cams to selectively engage chosen wrapping devices positioned around the circumference of the needle cylinder.

* * * * *